United States Patent [19]

Newcomb

[11] 4,279,200

[45] Jul. 21, 1981

[54] METHOD FOR PRODUCING NATURE PRINTS

[76] Inventor: Rosemarie Newcomb, 2227 Seely Dr., Orlando, Fla. 32808

[21] Appl. No.: 106,758

[22] Filed: Dec. 26, 1979

[51] Int. Cl.[3] ..... B41M 1/10

[52] U.S. Cl. ..... 101/170; 101/32

[58] Field of Search ..... 101/32, 150, 151, 170, 101/129, 426; 35/26–28; 264/293, 313

[56] References Cited

U.S. PATENT DOCUMENTS

| | | | |
|---|---|---|---|
| 1,661,573 | 3/1928 | Mitchell | 101/170 X |
| 1,827,685 | 10/1931 | Chester et al. | 101/170 X |
| 2,242,295 | 5/1941 | Foard | 101/426 |
| 2,700,629 | 1/1955 | Townsend | 101/170 X |
| 3,263,605 | 8/1966 | Fry et al. | 101/170 |
| 3,283,714 | 11/1966 | Carpenter et al. | 101/170 X |
| 3,298,881 | 1/1967 | Higley et al. | 101/32 X |
| 3,390,631 | 7/1968 | Koszul | 101/170 X |
| 3,553,062 | 1/1971 | Berlin | 35/26 |
| 3,573,136 | 3/1971 | Gardner | 101/32 X |
| 4,154,882 | 5/1979 | Ungar et al. | 101/32 X |

FOREIGN PATENT DOCUMENTS

| | | | |
|---|---|---|---|
| 1471694 | 12/1968 | Fed. Rep. of Germany | 101/170 |
| 320892 | 10/1929 | United Kingdom | 101/170 |

*Primary Examiner*—E. H. Eickholt
*Attorney, Agent, or Firm*—Macdonald J. Wiggins

[57] ABSTRACT

A method for producing unique works of art in which plants, flowers and other natural specimens are utilized to create artistic effects. A metal plate is etched or engraved to produce a desired pattern thereon. The plate is selectively inked with one or more colors. The plate is placed in a suitable press and natural specimens are artistically arrayed on the plate. A sheet of soft rag paper is placed over the plate and the natural objects thereon forming a print assembly. The press is operated to place pressure upon the backside of the paper, forcing the paper against the plate and the natural specimens. The ink is transferred from the plate to the paper to form blank areas having the shape of the natural objects. Natural color agents on the natural specimens will be expressed or leached out into the paper surface forming attractive, soft colors in the blank areas. Additionally, pressure from the press will cause portions of the natural specimens having three dimensional shapes to emboss such shapes into the soft paper. The press is opened, the specimens discarded and the finished print removed. The plate may be used to make additional prints, with each print having its own unique design.

6 Claims, 5 Drawing Figures

METHOD FOR PRODUCING NATURE PRINTS

BACKGROUND OF THE INVENTION

1. Field of the Invention

The present invention relates to the intaglio process and the embossing process for making a nature print, and more particularly to a process for preparing monoprints in which plants, flowers, and other natural objects are utilized in the process.

2. Description of the Prior Art

The combination of intaglio printing and embossing processes have been previously described. For example, U.S. Pat. Nos. 3,573,136 to Gardner and 3,390,631 to Koszul disclose processes using printing plates which combine both embossed elements and etched or engraved elements on the same plates. The present invention, however, is concerned with embossing by the use of three dimensional objects from nature. Such embossing has been noted in U.S. Pat. No. 3,298,881 to Higley, et al who teach the use of semi-rigid, thickly contoured biological specimens to emboss a heated thermoplastic sheet for displaying and studying of such specimens. However, the known prior art shows no combination of the intaglio printing process combined with the use of specimens from nature for embossing, coloring, and forming patterns to produce pleasing artistic works.

SUMMARY OF THE INVENTION

The present invention is a process for making a unique artistic work by combining an intaglio printing plate with various specimens from nature. The process lends itself to the production of a wide range of artistic prints limited only by the talent and imagination of the artist. A typical process will be described as exemplary of the invention.

A metal plate, which may be zinc, copper, or other suitable metal, is etched or engraved to produce a desired pattern thereon. After preparation of the metal plate, the plate is inked as if a straight print were to be made as is well known in the art. The printing ink may be applied to the plate as desired by the artist. For example, the etched or engraved portion may be filled with ink and the surface portions wiped clean, or only the surface portions inked, or combinations of the above may be used. Similarly, different color inks may be applied to various portions of the plate. When the plate is ready for use, it is laid face up in a suitable press. Next, natural objects such as flowers, moss, leaves, and the like are artistically arrayed on the plate, thus covering portions of the ink surface. A sheet of soft rag paper, such as "Italia" rag paper is placed over the inked plate and the natural objects thereon forming a print assembly. The press is then operated to place pressure upon the backside of the rag paper which forces the paper against the plate and the natural objects. Preferably, the paper is larger than the metal plate and one action of the press is to emboss or compress the soft paper by the metal plate, forming an attractive framed or matted appearance.

The ink from the prepared plate is transferred to the rag paper only over areas for which there is no natural object since each object, such as a leaf or flower, acts to block such transfer of ink over its area. Thus, the color transferred from the plate effectively outlines the leaf, flower, or other object producing generally a negative image effect of that object. Additionally, due to the pressure of the press, various natural colorings within the natural specimens will be expressed or leached out into the soft surface of the rag paper. The negative areas, created due to the presence of such objects, will therefore take on such leached colors which may be in contrast with the background ink and are, of course, related to the natural colors of the nature specimens. The colors thus extracted from nature generally form pastel tints, creating attractive soft colors and shading in the finished print.

Since portions of natural objects may be three dimensional, the pressure exerted by the press will compress the soft surface of the rag paper by such three dimensional portions and thereby emboss the particular shapes into the paper. As an example, if tendrils of spanish moss are utilized in the process, the result will be deeply embossed patterns of the tendrils arrayed in graceful and artistic curves, swirls, and loops. Since such moss contains no coloring, the embossed regions will be colorless and the ink from the plate will provide background color for emphasizing these patterns.

After a pressing operation, the print assembly is removed from the press and the natural objects discarded. The background plate may be reinked and used repeatedly with different natural objects for each printing. As may now be recognized, the process of the invention produces a one-of-a-kind artistic work which can reproduce delicate patterns of leaves, flowers, and other objects as well as a three dimensional effect on the surface of the paper which adds significant interest to the work.

It is therefore a principal object of the invention to provide a novel process for producing unique artistic works having characteristics of specimens taken from nature.

It is another object of the invention to provide a process for producing a work of art having a colored background pattern with negative patterns of such natural specimens present therein.

It is yet another object of the invention to provide a process for producing a unique work of art in which reproductions of natural productions are shown against a background pattern in which the reproductions are colored from leaching of the natural coloring agents of the specimens.

It is still another object of the invention to provide a process for producing a work of art on a soft-surfaced paper wherein three dimensional shapes of the natural specimens may be embossed.

It is a further object of the invention to provide a process for producing a unique work of art having soft pastel coloring, delicate natural patterns of natural specimens, and an embossed surface of the work, all combining to delight and satisfy the eye of the observer.

These and other objects and advantages of the invention will be understood from the following detailed description when read in light of the drawings.

DESCRIPTION OF THE PREFERRED EMBODIMENT

Figure 1:
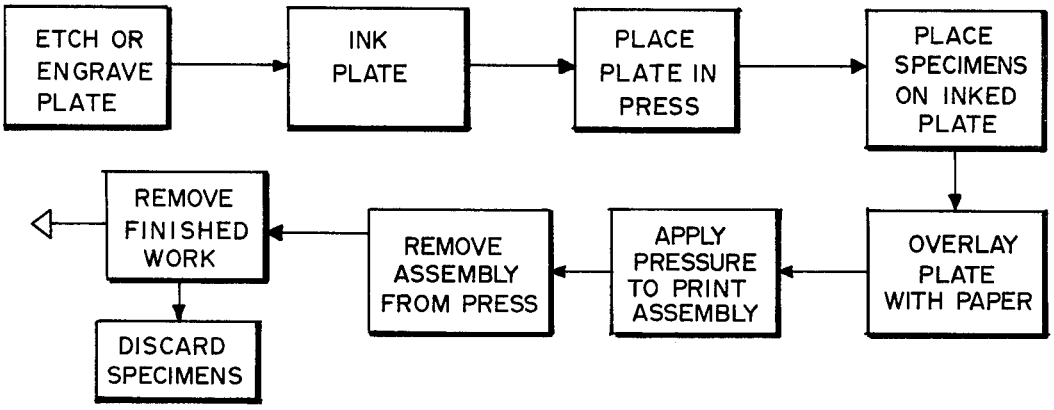
FIG. 1 is a flow diagram showing the basic steps in the process of the invention.

Referring to FIG. 1, a simplified operational flow diagram of the process of the invention is shown. The artist first etches or engraves a metal plate which may be of zinc, copper, or other materials suitable for use with the intaglio process. After the plate is prepared, the artist inks the plate in such a manner as to produce the desired background effect in the completed work. Various combinations of colors and inking of areas may be used such that both engraved portions and relief portions of the plate may be utilized. After inking, the plate is placed in a press and arranged to allow specimens to be placed over inked portions of the plate. Unusual and attractive works of art may be produced with the process of the invention by using specimens from nature such as leaves, flowers, moss, grains, and many other forms of plant life limited only by the imagination of the artist. Other specimens may include insect parts such as wings, as well as inanimate and manmade objects of appropriate form. After the appropriate specimen has been placed on the inked plate in the desired pattern, the paper on which the finished work is to be formed is laid over the plate and specimens forming the print assembly. Preferably, the paper should be slightly larger than the size of the plate. Although many types of paper and other materials are suitable for practicing the process of the invention and various types of materials will produce differing effects, the preferred paper is a soft rag stock such as a "Italia" rag paper.

After overlaying the paper, the press is operated to apply pressure to the print assembly so as to squeeze the paper and plate between the press surfaces. The amount of pressure to apply is a variable which may be controlled by the artist to produce varying effects and patterns in the finished work. For example, where a heavy embossed effect is desired, heavier pressure is applied then when a simple negative effect from the specimens is intended. After pressing, the print assembly is removed from the press and the paper removed from the plate. As may now be understood the inked portions of the plate will have offset or printed on the paper only where no specimen was present. Thus, a negative outline of the various specimens will be achieved. Where the specimen includes semi-rigid, three dimensional portions, such portions will compress the soft paper, producing a recessed or embossed effect. Although no ink will appear normally within the outline of the specimen, color may appear in such are when the specimen is a plant portion such as a leaf, flower, or the like due to the natural coloring elements leaching from the specimen into the paper under pressure from the press. The print assembly is then removed from the press and the finished work removed from the assembly. After removal of the work, the specimens are generally removed from the plate and discarded. The background plate may be cleaned, re-inked, and utilized with new specimens for another pressing. Thus, a single background plate may serve to produce many unique artistic works.

Figure 2:
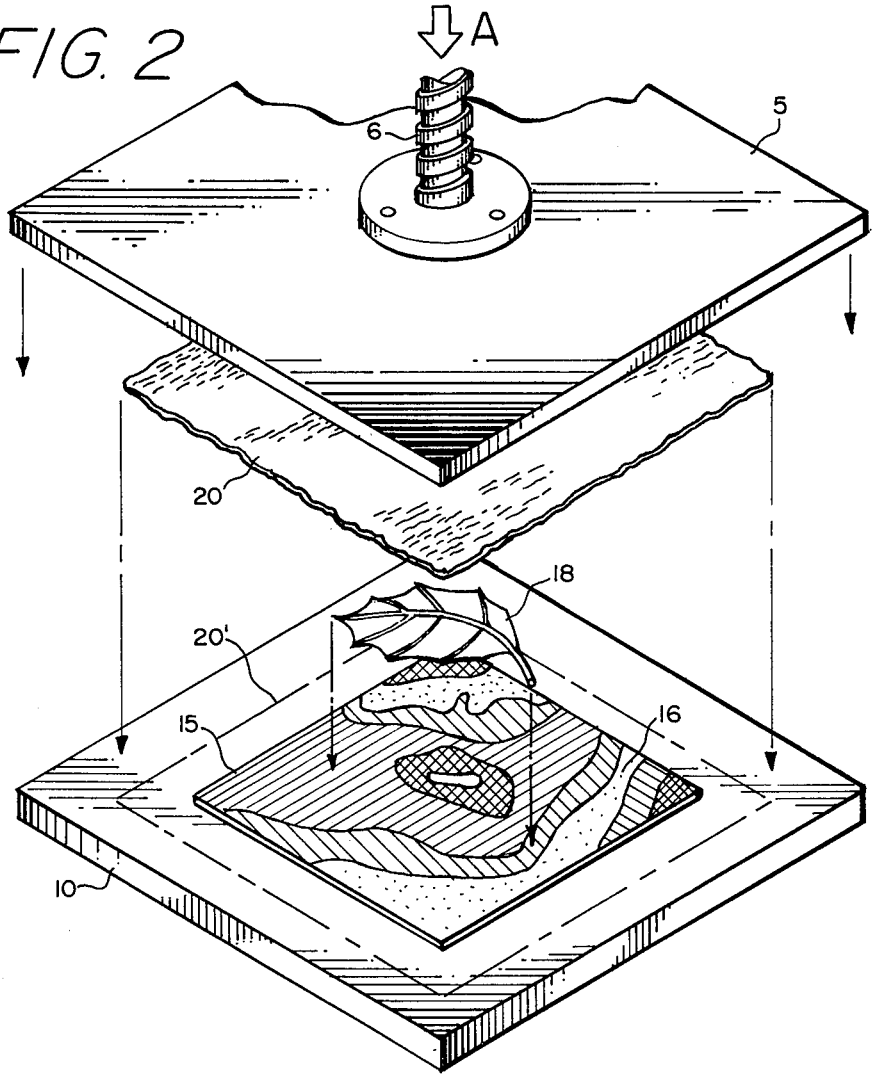
FIG. 2 is an exploded view of a screw press shown in partial view producing a simple example of a work of art through the process of the invention.
Figure 3:
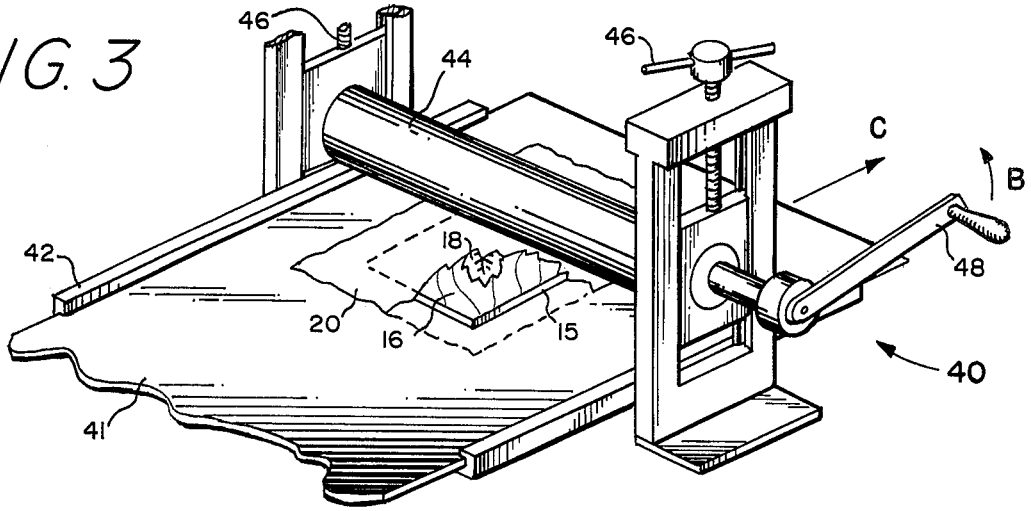
FIG. 3 is a perspective view of a preferred roller-type etching press producing a print from the exemplary assembly.

To illustrate the process in more detail, a simple example of the use of a background plate with a single leaf as the specimen will be described with reference to FIGS. 2, 3, and 4. It is to be understood that the illustrated work is for purposes of explaining the process of the invention and is not presented as a work of art. Turning to FIG. 2, sections of a small hand screw press are shown as elements 5, 6, and 10 with element 10 serving as the lower bed, element 5 serving as the upper bed, and feed screw 6 utilized with a frame and hand wheel (not shown) to apply pressure to the work as indicated by open face arrow "A". The print assembly of FIG. 2 is shown having an arbitrary abstract pattern 16 etched or engraved on its face surface and inked preparatory to a pressing. The various cross hatchings of the areas of pattern 16 are to indicate different colors or shades of ink. A leaf 18 is, for illustrative purposes, placed over the center portion of pattern 16 on plat 15. Next, a piece of soft rag paper 20 is placed over the leaf 18 and plate 15 in the position 20′ as by broken lines. As will be described further, it is preferable that the size of paper 20 be greater than that of plate 15 to allow a margin in the finished work. As will be obvious to those of skill in this art, paper 20 may be white, or any desired color appropriate to the work. For purposes of the example, however, it will be assumed that paper 20 is white. With the press in its closed position, feed screw 6 is tightened forcing movable bed 5 downward as shown by arrow A forcing paper 20 into contact with inked pattern 16 of plate 15 with the central portion in contact with leaf 18.

As previously mentioned, the pressure to be exerted is controlled by the artist in accordance with the final effects desired. Where pronounced three-dimensional or embossing effects are sought, heavy pressure may be utilized. Heavy pressure will also force coloring from leaves, flowers and the like to add color to the negative images.

Although a hand screw press has been shown to illustrate the process of the invention, it is preferred to use a more conventional rotary-type etching press. For example etching press 40, shown in partial view in FIG. 3, is depicted in the process of producing a work for the print assembly of FIG. 2 with paper 20 partially cut away to show inked plate 15 with background pattern 16 and leaf specimen 18. The desired pressure of press 40 is controlled by roller screws 46. As crank 48 is turned in direction B, bed 41 moves in synchronism with roller 44 to pass the print assembly beneath roller 44 in the direction of arrow C. An etching press is partially well suited for the process of the invention since the pressure exerted can be finely adjusted and indexed to permit repeatability for a particular papers and specimens used.

Figure 4:
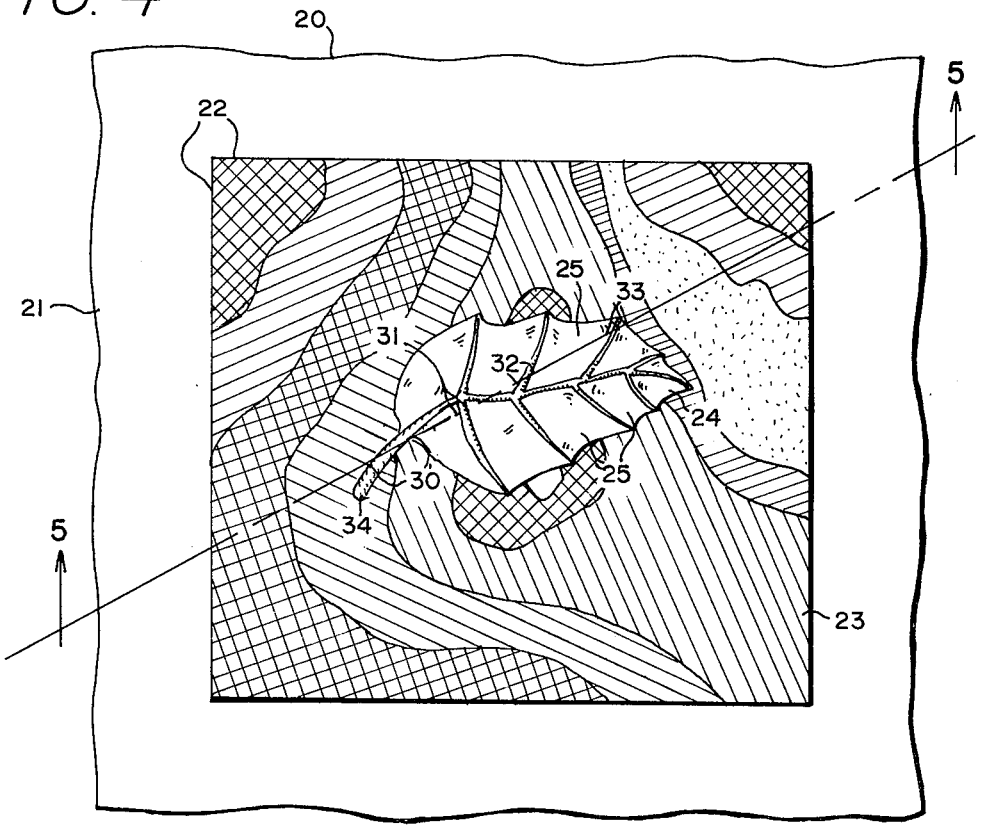
FIG. 4 is a plan view of the exemplary simple work of art produced by the arrangement shown in FIG. 2.
Figure 5:
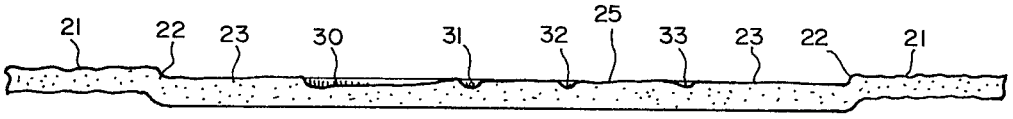
FIG. 5 is a cross-section, not to scale, through plane 5—5 of the paper shown in FIG. 3.

Turning now to FIGS. 4 and 5 the result of the above described pressing is shown. In the plan view of FIG. 4, it may be noted that the inks from pattern 16 have offset or transferred to paper 20 as shown at 23. The edges of plate 15 have been forced by the press into the soft surface of paper 20 embossing a border line 22 into the paper as best seen in the cross-sectional view of FIG. 5 through plane 5—5 of FIG. 4. As may be recognized, this operation leaves a clean, white border 21 surrounding the printed portion of the paper. The edges of paper 20 may be trimmed to produce the desired border dimension of the finished work. Pattern 23 may be noted to have printed within border line 22 except where leaf 18 was placed. Thus, an outline 24 of leaf 18 is left which, in effect, forms a negative image of the leaf. In addition, due to the three dimensional nature of stem and veins 34, these portions have been forced into the surface of the paper, creating a desired recessed or embossed effect best seen in FIG. 5. For example the segment of stem 30 may be seen in the cross-sectional view of FIG. 5 to have compacted the paper to form the illustrated compression. Similarly, veins 31, 32 and 33 have made slight depressions in the surface of the paper. Thus, in addition to the negative image of leaf 18, the embossing of its stem and vein structure produces a more interesting and natural look to the image. Assuming now that a fresh green leaf were used in the pressing operation, it will be found that the natural sap or fluids in the leaf will have been forced through the surface of the leaf into paper 20 carrying the green coloring as indicated at 25. Thus, a pastel shade of green may be expected to be leached into the flat areas of the leaf. In some leaves, it may be found that the stem and veins do not produce such colors and the contrast between the white embossed areas and the delicately colored leached areas provides a very attractive appearance.

As may now be recognized from the simple example described above, the selection by the artist of appropriate patterns and colors for the background 23 and of the type and shape of specimens such as leaf 18 can result in the production of interesting, attractive, and unusual one-of-a-kind artistic works.

Although the process of the invention has been herein disclosed with reference to a simple example, it will be obvious to those of skill in the art that many variations in types of background plates, natural and man-made specimens, paper stock and presser may be utilized without departing from the spirit or scope of the invention.

I claim:

1. A process for producing a unique work of art comprising the steps of:

(1) preparing a printing plate with a background design;

(2) inking the printing plate;

(3) disposing specimens from nature on the inked surface of the plate;

(4) overlaying the plate and natural specimens with a material to be printed; and (5) applying pressure to plate and materials to cause inked areas of the plate to offset to the surface of the material except where blocked by the natural specimens thereby producing a negative uninked outline of such specimens and to cause natural coloring within the natural specimens to be expressed therefrom and to leach into the surface of the material within such outline for providing color thereto.

2. The process for producing a unique work of art comprising the steps of:

(1) preparing a printing plate with a background design;

(2) inking the printing plate;

(3) disposing specimens from nature on the inked surface of the plate;

(4) overlaying the plate and natural specimens with a soft surface paper to be printed; and (5) applying sufficient pressure to the plate and paper to cause inked areas of the plate to offset to the surface of the paper except where blocked by the objects thereby producing a negative uninked outline of such objects, to cause natural coloring within such natural specimens to be expressed through the surfaces thereof and leached into the paper, and to force three dimensional portions of such natural specimens into the surface of the paper embossing a subsurface outline thereof.

3. The process as defined in claim 1 or 2 in which the step of applying pressure includes the step of:

placing the assembly resulting from steps 1 through 4 in a press; and operating the press to provide the required pressure.

4. The process as defined in claim 1 or 2 in which the step (1) includes a step of etching a design into the surface of the plate.

5. The process as defined in claim 1 or 2 in which the step (1) includes the step of engraving a design into the surface of the plate.

6. The process as defined in claim 2 in which:

step (4) includes the step of selecting a paper larger than the printing plate which will cover and overlap the plate; and step (5) includes applying sufficient pressure to the plate and paper to cause the edges of the plate to emboss a border line enclosing the background design into the surface of the paper.

* * * * *